US006053188A

United States Patent [19]

Walker

[11] Patent Number: 6,053,188

[45] Date of Patent: Apr. 25, 2000

[54] UMBRELLA

[76] Inventor: Neil Edward Walker, 877 Normandy Trace Rd., Tampa, Fla. 33602

[21] Appl. No.: 09/328,784

[22] Filed: Jun. 9, 1999

Related U.S. Application Data

[62] Division of application No. 08/123,641, Sep. 17, 1993.

[51] Int. Cl.[7] ..... A45B 19/06

[52] U.S. Cl. ..... 135/26; 135/27; 135/29; 135/31; 135/32

[58] Field of Search ..... 135/15.1, 27, 29, 135/31, 33.2, 33.41, 23, 26, 25.31, 25.33, 98

[56] References Cited

U.S. PATENT DOCUMENTS

| | | | |
|---|---|---|---|
| 765,287 | 7/1904 | King | 135/26 X |
| 929,117 | 7/1909 | Black et al. | 135/26 X |
| 1,265,704 | 5/1918 | Howard et al. . | |
| 1,282,387 | 10/1918 | Del Re . | |
| 2,072,254 | 3/1937 | Evans . | |
| 2,185,466 | 1/1940 | Jostes . | |
| 2,492,376 | 12/1949 | Brillas . | |
| 2,531,735 | 11/1950 | Jones . | |
| 2,579,748 | 12/1951 | Matthews . | |
| 2,816,560 | 12/1957 | Wuster . | |
| 3,042,055 | 7/1962 | Todorovic . | |
| 4,312,371 | 1/1982 | Koon . | |
| 4,658,843 | 4/1987 | Raymond . | |
| 5,226,438 | 7/1993 | Dubonsky . | |
| 5,305,771 | 4/1994 | Wilk . | |

FOREIGN PATENT DOCUMENTS

| | | |
|---|---|---|
| 2977 | 11/1863 | United Kingdom . |

*Primary Examiner*—Carl D. Friedman
*Assistant Examiner*—Winnie Yip
*Attorney, Agent, or Firm*—James H. Beusse; Holland & Knight LLP

[57] ABSTRACT

An umbrella comprising a central shaft having an upper end and a lower end with the lower end including a handle incorporates a plurality of pivotable members each having a first end pivotally coupled to an upper end of the shaft and being circumferentially spaced about the shaft and oriented generally parallel thereto when the umbrella is in a collapsed condition. A plurality of flexible members are operatively associated with corresponding ones of the pivotable members. The flexible members are each expandable into a generally hoop-shaped configuration adjacent another end of the pivotable members when the pivotable members are pivoted from a collapsed condition to an operative position. The open umbrella appears as a canopy stretched over a plurality of circumferentially spaced ribs with each rib terminating in a hoop-shaped member.

14 Claims, 5 Drawing Sheets

UMBRELLA

This is a divisional of application Ser. No. 08/123,641 filed Sep. 17, 1993.

BACKGROUND OF THE INVENTION

The present invention relates to umbrellas and to an improved frame and canopy assembly for umbrellas.

The general construction of the umbrella has changed little since its initial introduction in ancient Egypt, although the development of the steel frame in about 1850 reduced its weight considerably. The umbrella structure comprises a central support shaft having a handle at a lower end and a plurality of circumferentially spaced ribs extending outwardly from an upper end of the shaft. A canopy is stretched over the extending ribs and attached to the distal ends of the ribs. Commonly, the ribs are curved downwardly to create a concave undersurface providing improved protection for the user. Unfortunately, such curvature brings the ends of the ribs to about eye level creating a hazard when umbrellas are used around other persons. The hazard from getting "poked" by the pointed ends of umbrellas is so well recognized that umbrellas are often banned from use in large gatherings, such as at major sports events such as football games.

SUMMARY OF THE INVENTION

Among the several objects of the present invention may be noted the provision of an improved frame and canopy for an umbrella; the provision of an umbrella frame which eliminates eye hazards from rib ends; the provision of a canopy-to-frame connection which eliminates high stress, rib end connectors; and the provision of a canopy which is easily replaceable.

The above and other objects, features and advantages are in part pointed out and in part apparent in the description to follow. The invention is illustrated in one form in an umbrella having a frame comprising a central shaft having an upper end and a lower end, the lower end terminating in a handle. A plurality of relatively rigid slide members are pivotably attached to the upper end of the shaft and uniformly circumferentially spaced thereabout. A generally flexible member is coupled to a distal end of each of the slide members and operatively connected to a respective slide member such that pivoting of the slide member into a position approximately perpendicular to the shaft causes each flexible member to expand into a hoop-like configuration. The resultant canopy support comprises a plurality of circumferentially spaced hoops, each connected to the central shaft by a respective one of the slide members. A canopy is stretched over the support and releasably attached to the radially outer edges of the hoops.

In one form, each flexible member comprises a pair of leaf-spring like elements joined by a hinge at a radially outer end,from the shaft. The inner ends of the elements are slidably attached to a respective slide member and the outer ends are held at a fixed distance from the slide member. Sliding of the inner ends toward the outer ends forces the elements to balloon outward thus forming the hoop-shaped configuration. In one form, the slide member includes a lengthwise slot having a plurality of pins passing therethrough for slidingly supporting the inner ends of the flexible elements. In another form, the inner ends of the flexible elements have a single guide pin riding in the slot and pass through a support loop at the outer end of the slide member. A relatively rigid strut is also attached to the pin or pins at one end thereof. Another end of the strut is attached to a slidable bracket on the central shaft. As the bracket is pushed toward the upper end of the shaft, the one end of the strut pushes the slide member toward an operative position while concurrently pushing the inner ends of the flexible members toward their outer ends forcing formation of the hoop shape. Conversely, sliding the bracket downward allows the hoops to collapse and folds the slide members against the shaft.

BRIEF DESCRIPTION OF THE DRAWINGS

For a better understanding of the present invention, reference may be had to the following detailed description taken in conjunction with the accompanying drawings in which.

DETAILED DESCRIPTION OF THE PREFERRED EMBODIMENT

Figure 1:
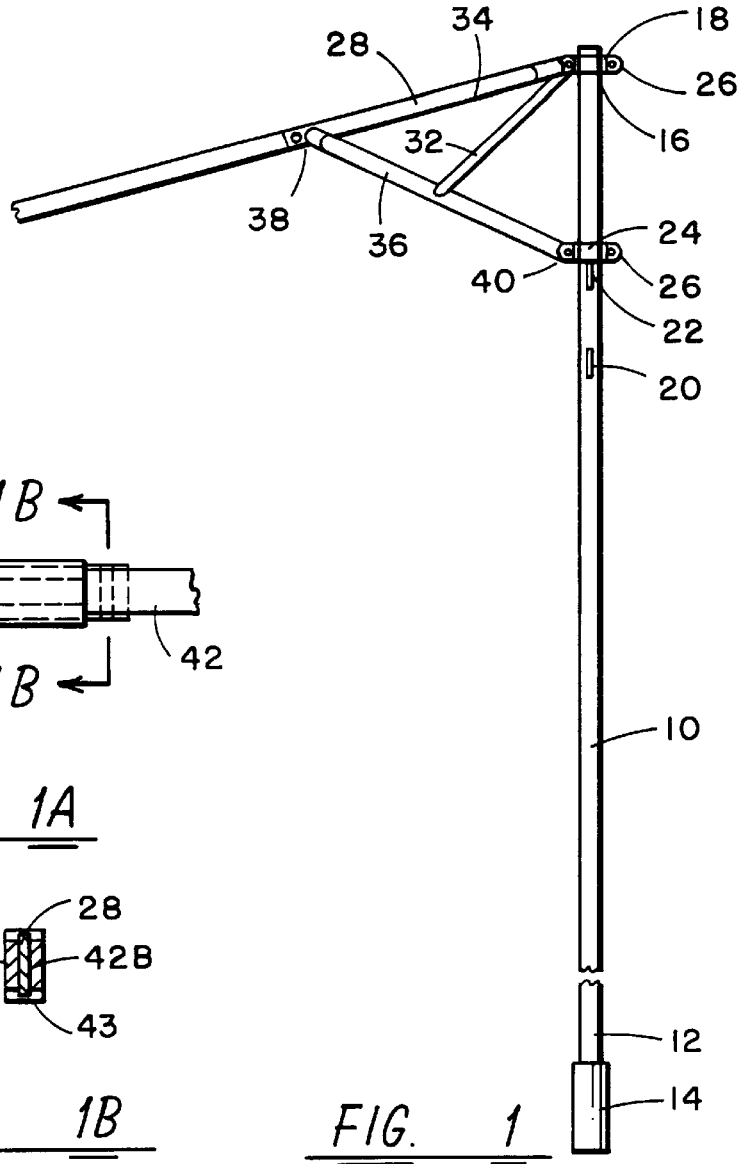
FIG. 1 is a partial elevation view of an umbrella frame structure in accordance with the present invention.
Figure 2A:
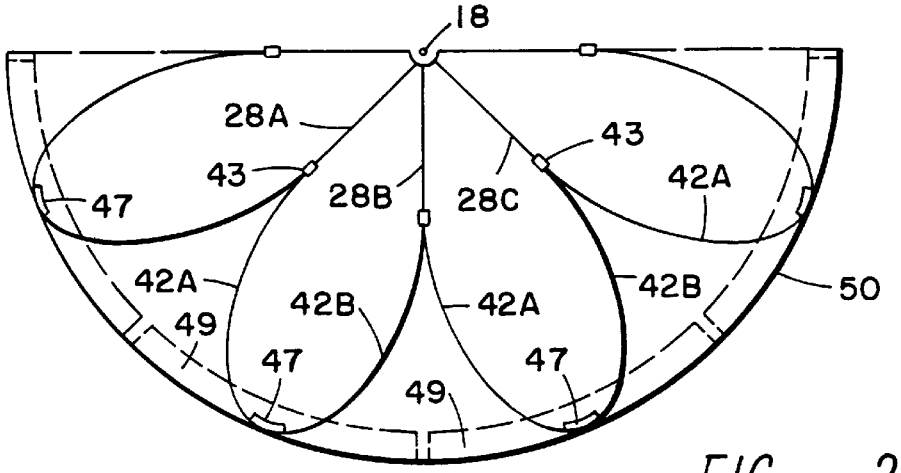
FIG. 2A is a partial plan view of an alternate embodiment of the umbrella structure of FIG. 2.
Figure 2:
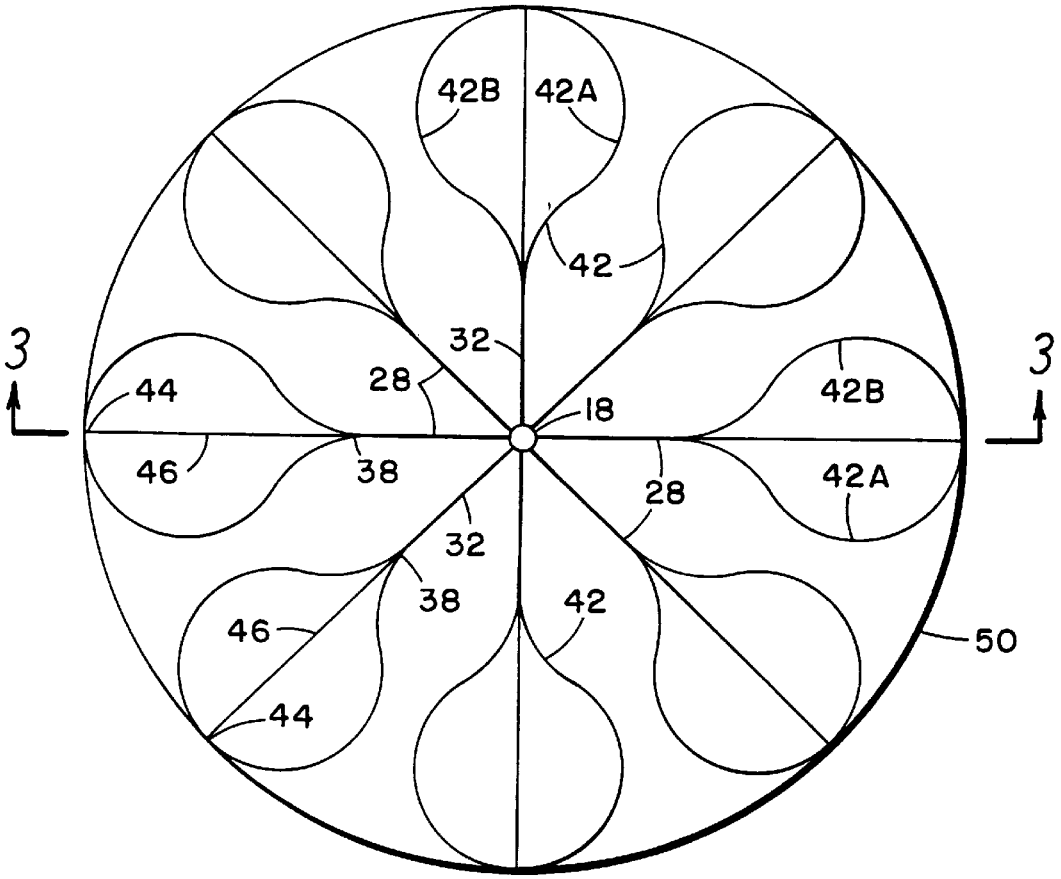
FIG. 2 is a top plan view of the structure of FIG. 1 with a canopy shown in phantom lines.

Referring to FIGS. 1 and 2, there is shown a partial elevation view and a plan view, respectively, of a frame structure for an umbrella in accordance with the present invention. A central shaft 10 has a lower end 12 terminating in a handle 14 and an upper end 16 to which is attached a fixed bracket 18. The shaft 10 may be substantially identical to a conventional umbrella shaft and has a pair of spring loaded stops 20, 22 which protrude through slots in the shaft and can be depressed into the shaft to allow a sliding bracket 24 to be moved into positions supported by the two stops, although it is believed that the lower stop 20 may be unnecessary. The upper fixed bracket 18 may be pinned, press-fit, welded or adhesively bonded to shaft 10. Brackets 18 and 24 are substantially identical in design and comprise a circular collar from which a plurality of circumferentially spaced tabs 26 extend radially outward.

A relatively rigid slide member 28 has a first or near end pivotably connected to one of the tabs 26 by a pivot passing through aligned apertures in each of the member 28 and tab 26. In one form, the pivot comprises a deformed end of a brace 32, the end of the brace being bent to pass perpendicularly through the member 28 and tab 26. Slide member 28 is formed with a lengthwise extending slot 34 over substantially its entire length. A relatively rigid strut 36 extends between slide member 28 and lower sliding bracket 24. Strut 36 is slidingly coupled to member 28 by a pin 38 passing through slot 34 and an aperture in an end of strut 36. An opposite end of strut 36 is pivotably coupled to bracket 24 by another pin 40 passing through aligned apertures in the strut and a corresponding one of the tabs 26. The brace 32 extends from upper bracket 18 to a connection point on strut 36 where another deformed end of brace 32 passes through an aperture in strut 36. It has been found that the umbrella frame opens more easily if the brace 32 is connected to strut 36 at a point closer to the slide 28 than to the center rod 10. More particularly, the length of brace 32 should be about 1.3 times or more greater than the distance from its connection point on strut 36 to the strut connection at slide 28. Further, the brace 32 length should exceed the length from the brace 32 connection point to the slide member 28 by greater than the distance from the inner side of the slot 34 to upper bracket 18 connection at tab 26.

The term "relatively rigid" is used only to indicate that the associated element, such as slide member 28, is generally capable of maintaining its normal configuration such as being relatively straight. However, such elements are not intended to be inflexible, i.e., the corresponding ribs of a conventional umbrella are also "relatively rigid" but can be flexed into an arcuate shape to produce the conventional concave umbrella configuration. In the same manner, it is desirable that the slide members 28 be capable of being flexed when the umbrella frame of the present invention is opened so as to produce this desirable concave curvature configuration.

The operation of the frame structure thus far described is generally similar to operation of a conventional umbrella. Starting with the frame in a folded position, the slide member 28 is aligned about parallel to shaft 10. The frame transitions to an open position by depressing stop 20, if such stop is used, and sliding bracket 24 upward. This action causes the upper end of strut 36 to slide in slot 34 from an upper end of the slot adjacent bracket 18 toward the opposite end as strut 36 pivots about the rotating pivot point formed by the deformed end of brace 32 passing through the approximate mid-point of strut 36. The sliding movement of the upper end of strut 36 pushes the slide member 28 upward and outward from shaft 10 in a pivoting motion. The bracket 24 is slid over stop 22 which stop then holds the bracket in an up position to maintain the frame structure open.

Figure 1A:
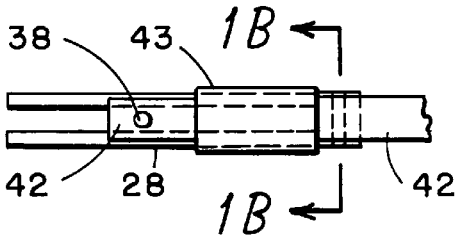
FIG. 1A illustrates an alternate embodiment of the slide member of FIG. 1.
Figure 1B:
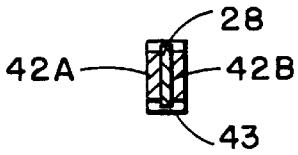
FIG. 1B is a cross-section taken along the line 1B—1B of FIG. 1A.

In prior art umbrellas, the slide member 28 would be similar to a rib extending from the shaft 10 to an outer periphery of the umbrella. The distal end of this rib would create the potential poking or eye hazard discussed above. In the present invention, the slide member 28 terminates immediately adjacent the outer end of slot 34. A flexible member 42, sometimes referred to as a petal because of the umbrella frame's flower petal shape when open, extends from member 28 to the outer periphery of the frame structure. In one form, and referring to FIG. 2, the member 42 comprises a pair of spring steel elements 42A and 42B, having their outer ends pivotably joined at 44 and their inner ends joined at pins 38. However, it is contemplated that the elements 42A, 42B could be formed of a plastic material. Multiple pins 38 are used to support petal 42 along a longitudinal axis of member 28. Preferably, the outer ends of elements 42A and 42B are formed with an overlapping hinge joint through which an end of a inelastic cable 46 is passed. An opposite end of cable 46, which may be piano wire, is coupled to an outer end of member 28, preferably by bending the end of cable 46 and inserting into an aperture in member 28. In an alternative embodiment, the inner ends of elements 42A and 42B may be attached to a tubular member (not shown) which would slide over the slide member 28 similar to a trombone section. In another form, shown in FIG. 1A, a support loop 43 is formed or attached to the outer or distal end of member 28 with the inner ends of petal 42 passing through the loop 43. In this embodiment, only one pin 38 is needed in conjunction with loop 43 to support petal 42. The loop 43 may be attached using a conventional adhesive, such as an epoxy resin.

It will now be seen that opening of the frame structure will cause the inner ends of elements 42A, 42B to be pushed toward the outer ends thereof. Since the outer ends of the elements are fixed in position relative to member 28, the elements 42A, 42B are forced to bow outward, as shown in FIG. 2, to form a hoop-shaped or tear-drop configuration. In the illustrative form, eight members 42 are uniformly spaced about shaft 10 to form a generally circular outer configuration for the frame structure. As can be seen, the outer periphery of the frame structure appears as an interrupted sequence of arcuate segments of each of the hoop-shaped members 42.

Figure 3:
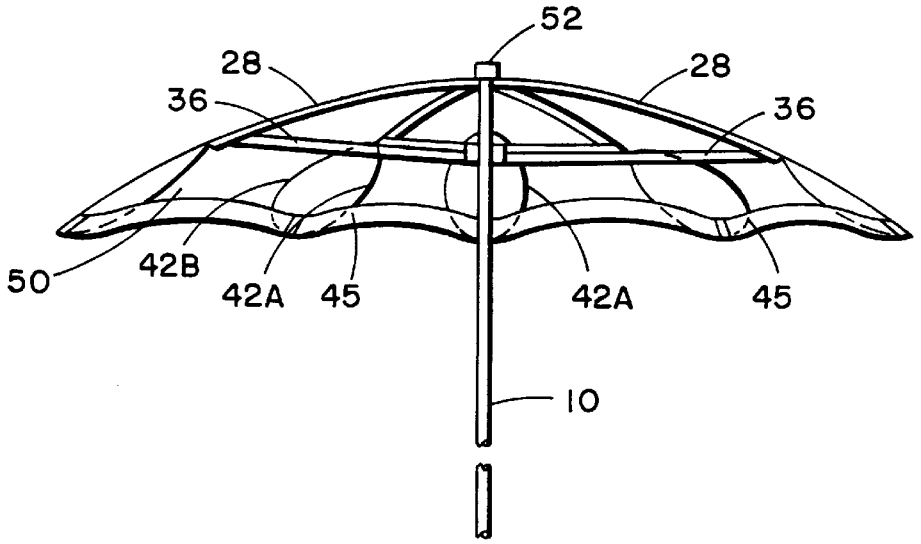
FIG. 3 is a cross-section taken along lines 3—3 of FIG. 2.
Figure 4:
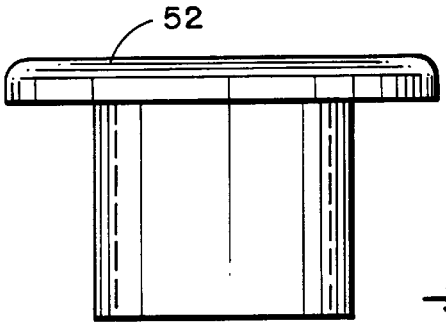
FIG. 4 is a representation of one form of cap used with the structure of FIG. 1.

The umbrella is completed by a canopy 50, FIGS. 2 and 3, stretched over the frame structure and attached by hook-and-loop straps or snaps (not shown). Since the elements 42A, 42B each form generally circular hoops, straps or snaps can be incorporated in the canopy such that the outer edges of the canopy can be attached about the elements 42A, 42B at their hinge points. It is also contemplated that the cable 46 may be omitted and the canopy used to restrain the outer ends of the members 42. In this form, it is also expected that the center of the canopy would be attached to the shaft 10, such as by a central cap which would attach to shaft 10 and capture canopy 50. Such a cap could be threaded or adapted for snap-fit into or onto the upper end of shaft 10. One such shaft cover or cap is shown at 52 in FIG. 4 and is designed for snap-fit over the upper end of shaft 10. The members 42 could fit into preformed pockets 45 in the outer periphery of the cover or the periphery of the cover could be looped over and sewn to the members 42. With simple pockets, hook and loop fasteners could be used to assure restraint of the cover.

It is believed that the brace 32 may be eliminated if the hoop/slide dimensions are adjusted such that the inner end of the slot 34 is three to four inches out from the shaft 10, assuming an overall slide member length of six to seven inches. In the case of a slide trombone implementation, the inner end of the slide member 28 would contain a mechanical stop about three inches out from the shaft 10, corresponding to the closed position for the hoops or petals 42. In the present drawings, the inner ends of the closed hoops 42 are very close to the shaft 10, requiring a mechanical advantage (as provided by the brace 32) to lift and open the hoops. If the closed hoops' inner ends were about three inches out from the shaft 10, applying pressure via the strut 36 would force the hoop sections to lift. As the tautness of the cover limited the upward travel, continued pressure would then open the hoops. This implementation would resemble the central portions of the illustrated implementation with a mechanical stop placed at an appropriate inner point on each member 28, and with each hoop 42 affixed to each member 28 via an outer shell which slides over each member 28. Note that the cover 50 is used to limit upward travel of the members 28 in the same manner as in a conventional umbrella. Upward travel could also be limited by adding an appropriate mechanical member 28-shaft 10 angle-limiting means to the frame.

Another form of the invention is shown in the partial plan view of FIG. 2A. In this form, the hoops or petals 42 are created by joining one of the elements 42A associated with one of the slide members 28A to an adjacent element 42B associated with an adjacent one of the slide members 28B. The elements 42A and 42B may be joined at their distal ends in the hinged manner described above or by other means such as by capturing the distal ends in a sleeve of heat shrinkable tubing 47. The advantage of the system of FIG. 2A is that the elements 42A, 42B do not attempt to bend in a common direction and the cable 46 can be eliminated. The distal ends of the elements 42 are preferably captured in pockets 49 in the canopy 50.

Figure 5:
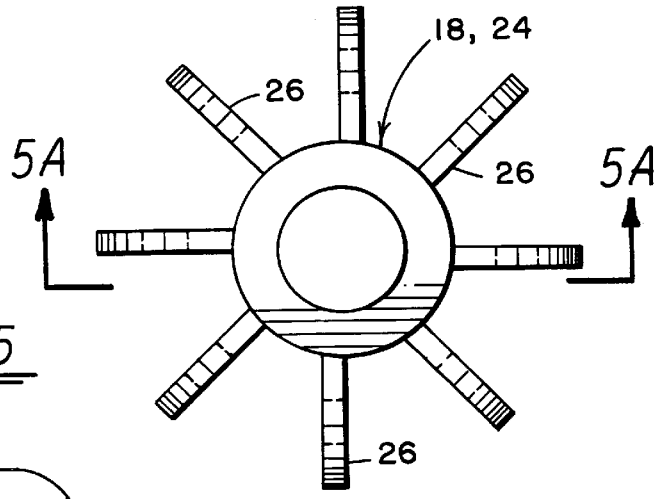
FIGS. 5 and 5A are plan and cross-sectional views of a bracket used in the structure of FIG. 1.
Figure 5A:
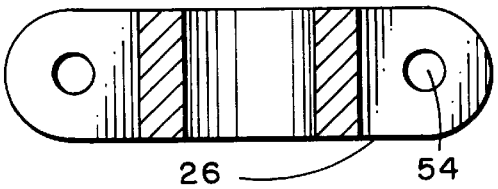
Figure 6:
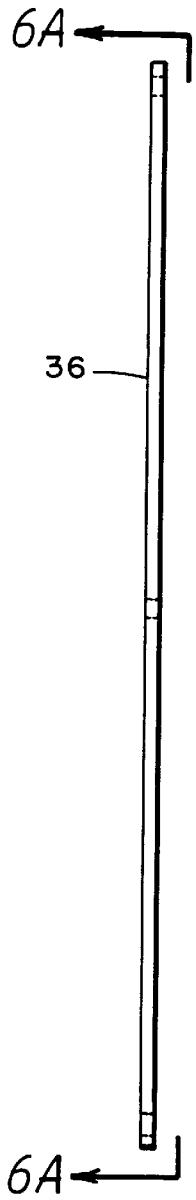
FIGS. 6 and 6A. are top and side views of the strut of FIG. 1.
Figure 6A:
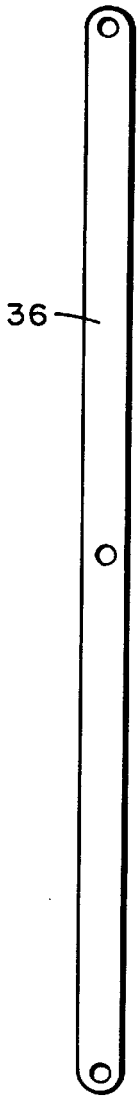
Figure 7:
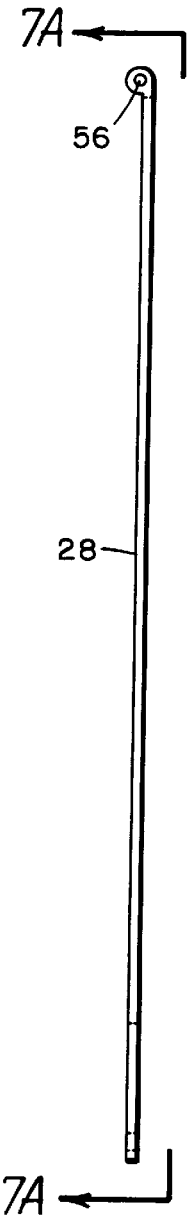
FIGS. 7 and 7A are top and side views of the slide member of FIG. 1.
Figure 7A:
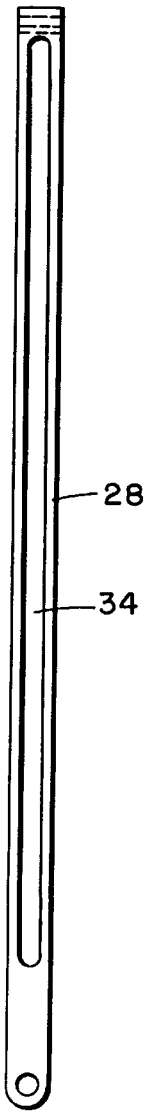
Figure 8:
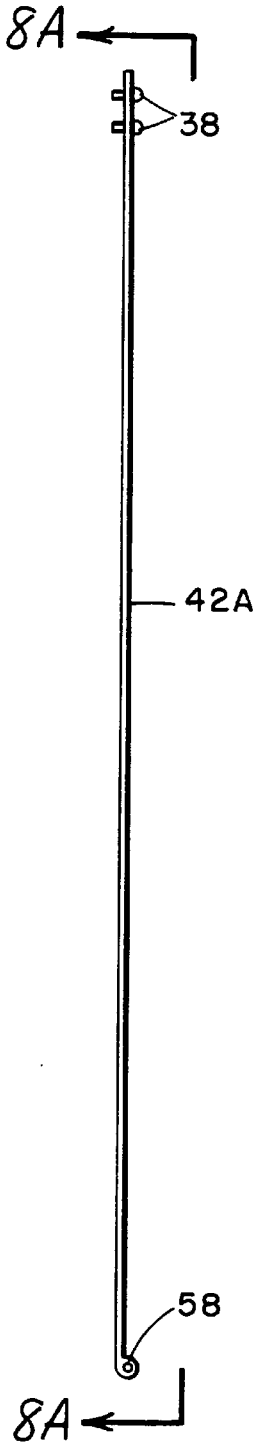
FIGS. 8 and 8A are top and side views of the flexible element or petal of FIG. 1.
Figure 8A:
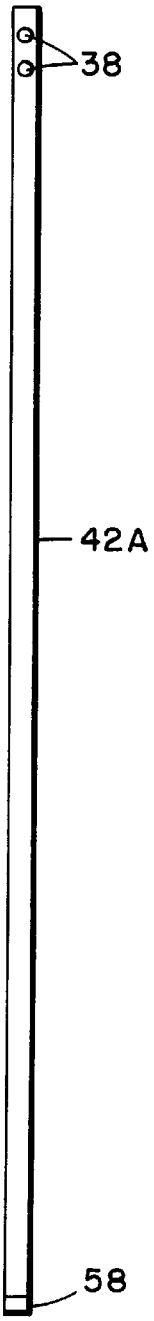

FIGS. 5–9 are detail drawings of each of the elements described above with regard to the inventive umbrella frame structure. FIGS. 5 and 5A are plan and cross-sectional views, respectively, of a preferred form of the brackets 18 and 24. Each tab 26 is identical and includes apertures 54 for attachment of the slide member 28 or strut 36. FIGS. 6 and 6A are top and side views of the strut 36. FIGS. 7 and 7A are top and side views of the slide member 28. It will be noted that the aperture 56 at the distal end of member 28 is oriented transverse to the direction of the slot 34, i.e., if the slot 34 is oriented to pass horizontally through the member 28, the aperture 56 is oriented vertically. When the end of cable 46 is inserted in aperture 56, cable 46 is pulled taut by the petal or member 42. Each member 42A, 42B includes an aperture 58, see FIGS. 8 and 8A, which is oriented parallel to aperture 56. The end of cable 46 is inserted downward in aperture 56 and upward in aperture 58 so that the cable appears diagonal with respect to member 42. Further, cable 46 passes in this diagonal path between elements 42A and 42B thus separating the two elements. It has been found that this arrangement of the cable forces the elements 42A and 42B to bow outward away from each other rather than both bowing in the same direction. However, the better arrangement would be to have the cable 46 centered between the elements 42A and 42B. The advantage of passing the cable between the elements is to encourage the elements to bow outward rather than both elements attempting to bow in the same direction. This function can be achieved by using a flat belt of fabric as the cable 46 although separate pins are then needed to join the outer ends of the petal elements 42 and to attach the belt to the member 28. Another possibility for controlling the direction of bowing is to preform the elements 42 with a bending bias or to form the elements 42 of a segmented or serrated plastic or metal which favors one direction of bowing or is able to bow in only one direction.

Figure 9:
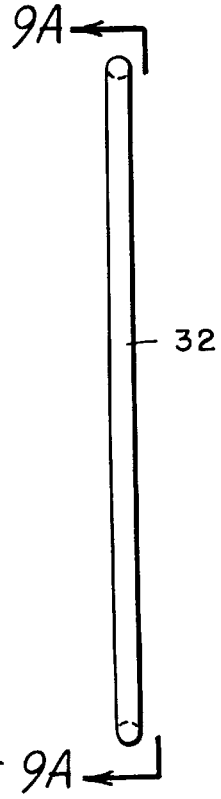
FIGS. 9 and 9A are top and side views of the brace of FIG. 1.
Figure 9A:
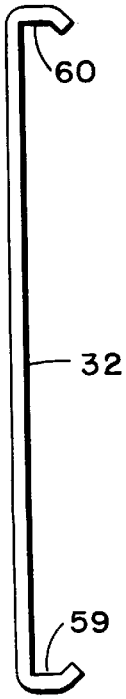
Figure 10:
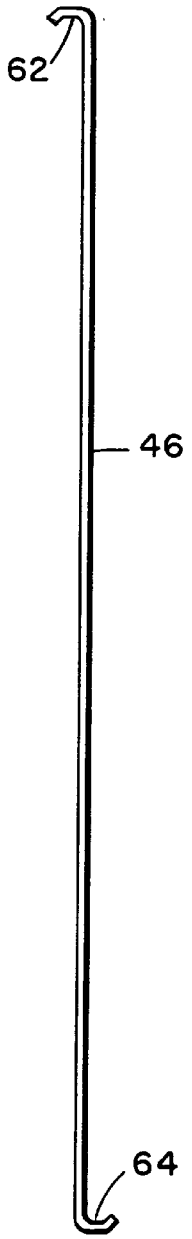
FIG. 10 is a side view of the cable of FIG. 2.

FIGS. 9 and 9A are top and side views of the brace 32 showing the deformed ends 59 and 60 which act as pivot pins in the illustrative design. FIG. 10 is a side view of the cable 46 showing the deformed ends 62 and 64, the end 62 being used as a hinge pin for pivotably joining the outer ends of elements 42A and 42B.

While the invention has been described in what is presently considered to be a preferred embodiment, many variations and modifications will become apparent to those skilled in the art. Accordingly, it is intended that the invention not be limited to the specific illustrative embodiment but be interpreted within the full spirit and scope of the appended claims.

What is claimed is:

1. An umbrella comprising:

a central shaft having an upper end and a lower end with said lower end including a handle;

a plurality of pivotable members each having a first end and a second end, said first end being pivotally coupled to said upper end of said shaft, said members being circumferentially spaced about said shaft and oriented generally parallel to said shaft when said umbrella is in a collapsed condition;

a plurality of flexible members operatively associated with said pivotable members, said flexible members each having a pair of opposite ends and being expandable into a generally hoop-shaped configuration adjacent said second end of said pivotable members when said pivotable members are pivoted from the collapsed condition to an operative position;

means for maintaining a fixed distance between an outermost periphery of said flexible members and said upper end of said shaft; and each of said pivotable members comprising a relatively rigid slide bar having a slot extending lengthwise thereof, at least one pin extending through said slot and through said opposite ends of corresponding ones of said flexible members, and means operable upon movement of said pivotable members from said collapsed condition for urging said pin in said slot away from said upper end of said shaft to effect expansion of said flexible members into said hoop-shaped configuration.

2. The umbrella of claim 1 wherein said means operable upon movement of said pivotable members comprises a strut having a first end slidably attached to said shaft and a second end attached by said pin to said flexible members.

3. The umbrella of claim 2 and including a brace having a first end pivotably coupled to said upper end of said shaft and a second end pivotably coupled to about a mid-point of said strut.

4. The umbrella of claim 1 wherein a pair of said flexible members are coupled to each of said pivotable members, each of said flexible members comprising a spring-like element, each spring-like element having a distal end and an adjacent end, distal ends of each pair of said spring-like elements being pivotably attached to one another and adjacent ends of each pair of spring-like elements being attached to said pin in said slot.

5. The umbrella of claim 4 and including means extending between said distal ends of said elements and said slide bar for fixing a distance between said distal ends and said slide bar.

6. The umbrella of claim 4 and including a canopy attached to said distal ends of said elements, said canopy limiting displacement of said distal ends from said shaft.

7. The umbrella of claim 4 and including a support loop attached to said another end of said pivotable members, said elements slidably passing through said loop whereby said loop and said pin support said elements to said pivotable members.

8. The umbrella of claim 5 wherein said extending means comprises a substantially inelastic cable.

9. The umbrella of claim 5 wherein said flexible members comprise spring steel bars.

10. The umbrella of claim 1 wherein a pair of said flexible members are coupled to each of said pivotable members, each of said flexible members comprising a spring-like element and each element having a distal end pivotably attached to a distal end of an adjacent element extending from an adjacent one of said pivotable members.

11. In an umbrella of the type having a central support shaft, a canopy and a plurality of radially extending ribs for supporting the canopy, an improved rib comprising a first rigid member pivotably mounted at one end thereof to an upper end of the support shaft and extending radially outward therefrom, a second flexible member having a near end slidably attached to a radially outer end of said first member and having a distal end fixedly positioned with respect to a distance between said distal end and the upper end of the support shaft.

12. The rib of claim 11 wherein said second member comprises a pair of spring-like elements pivotably attached to one another at said distal end, each of said elements having a near end slidably attached to said first member.

13. The rib of claim 12 and including an inelastic cable fastened between said distal end of said second member and said first member for fixedly positioning said distal end with respect to said first member.

14. The rib of claim 13 and including means for slidably urging said near ends of said elements toward said distal ends thereof for forcing said pair of elements to assume a hoop-shaped configuration.

* * * * *